United States Patent [19]

Petersen

[11] 4,391,207

[45] Jul. 5, 1983

[54] METHOD OF CONDITIONING EXHAUST GASES FROM COAL FIRING

[75] Inventor: Helge H. Petersen, Copenhagen, Denmark

[73] Assignee: F. L. Smidth & Co., Cresskill, N.J.

[21] Appl. No.: 313,795

[22] Filed: Oct. 22, 1981

Related U.S. Application Data

[63] Continuation of Ser. No. 60,598, Jul. 25, 1979, abandoned.

[30] Foreign Application Priority Data

Jul. 25, 1979 [GB] United Kingdom ..... 31061/78

[51] Int. Cl.[3] ..... F23B 7/00

[52] U.S. Cl. ..... 110/342; 44/15 R; 110/216; 110/347; 432/106

[58] Field of Search ..... 110/218, 342, 347, 343, 110/216; 44/15 R; 432/106

[56] References Cited

U.S. PATENT DOCUMENTS 3,920,380 11/1975 Heian ..... 432/106
4,111,755 9/1978 Ban ..... 110/342 X

FOREIGN PATENT DOCUMENTS 2807076 8/1979 Fed. Rep. of Germany ..... 110/342

*Primary Examiner*—Edward G. Favors
*Attorney, Agent, or Firm*—Pennie & Edmonds

[57] ABSTRACT

The present invention relates to operation of a rotary kiln plant utilizing electrostatic precipitators. Specifically, this invention is directed to a method for conditioning exhaust gases from a burning process in a rotary kiln in which mineral materials are treated by burning a fuel. The method comprises adding a water soluble alkali-metal compound to a solid fuel, at least part of which is a solid pulverized fuel, and then firing the fuel in the kiln plant, whereby the resistivity of the exhaust gases is less than about $10^{10}$ ohm cm.

10 Claims, No Drawings

METHOD OF CONDITIONING EXHAUST GASES FROM COAL FIRING

This is a continuation of application Ser. No. 060,598, filed July 25, 1979 now abandoned.

TECHNICAL FIELD

Generally, the present invention is concerned with a method of operating a rotary kiln plant of the type which utilizes electrostatic precipitators. Specifically, this invention is directed to conditioning exhaust gases from the burning process in the rotary kiln in which mineral materials are treated by burning a fuel, at least part of which is solid pulverized fuel.

BACKGROUND Art

It is well known that there are numerous problems associated with processes for precipitating dust from hot dust-laden exhaust gases from rotary kiln plants.

Usually electrostatic precipitators are used in such processes. In order to obtain thorough cleaning of the exhaust gases, various agents are used to condition the gases and to reduce the resistivity of the dust so that an improved performance of the electrostatic precipitator can be obtained. Cleaning efficiencies can be above 99 percent. The exhaust gases can be conditioned by injecting water or steam into them with or without various chemicals so that the resistivity of the dust is reduced to an acceptable level.

It is known to condition exhaust gases from the burning of mineral materials, especially cement raw materials to cement clinker, in rotary kilns. This is accomplished by dosing or injecting into the gases one or more water-soluble alkali-metal compounds as a conditioning agent before the gases are passed to an electrostatic precipitator.

This conditioning has a remarkable effect upon the resistivity of the dust. Resistivity is reduced to a level often below $10^{10}$ ohm cm. thereby making it possible to increase the filter current in and thus the efficiency of the precipitator.

When using solid fuel in rotary kilns, large amounts of fly ash are created and carried with the exhaust gases to the electrostatic precipitator. The particle size distribution of the fly ash in the exhaust gases is often such that the mean diameters of the particles are between 10 and 20 microns. These particles are difficult to precipitate and their resistivity often exceeds a critical value of about $10^{10}$ ohm cm. Use of low sulphur content coals, preferred in recent years to avoid air pollution by sulphur oxides, result in a resistivity above the critical value.

According to recent investigations, the presence of sodium in the ash, in amounts of 2 percent as $Na_2O$, reduces the resistivity of the fly ash from low sulphur coals below the critical value.

It is known to inject water-soluble alkali-metal compounds as a conditioning agent into the exhaust gases before they are passed to the precipitator. This serves to reduce the resistivity of any fly ash in the exhaust gases. However, by injecting the conditioning agents into the exhaust gases, it is not always possible to obtain regular distribution of the agents because the fly ash particles are extremely small and tend to remain in suspension as they pass through the precipitator. To obtain good conditioning results, multiple injection nozzles and injection chambers are required. This equipment complicates precipitator installation.

I have invented a method of conditioning exhaust gases from burning processes in which the resistivity of the exhaust gases is reduced without requiring complicated precipitator installations while improving performance of the electrostatic precipitator used in cleaning the gases. Thus, I have invented a method that overcomes the disadvantage of the prior art.

DISCLOSURE OF INVENTION

The present invention is generally directed to a method of conditioning exhaust gases from burning processes for treatment of mineral materials comprising:

(a) adding at least one alkali-metal compound to a solid fuel at least part of which is a solid pulverized fuel, and then (b) firing the fuel, whereby the resistivity of the exhaust gases is reduced.

More specifically, the present invention is directed to a method of conditioning exhaust gases from burning processes in a rotary kiln plant with an electrostatic precipitator for the treatment of mineral materials comprising:

(a) adding at least one alkali-metal compound to a solid fuel, at least part of which is a solid pulverized fuel, and then (b) firing the fuel in the kiln plant, whereby the resistivity of the exhaust gases is reduced.

BEST MODE FOR CARRYING OUT THE INVENTION

In a method of operating a rotary kiln plant having an electrostatic precipitator and fired with solid fuel, an alkali-metal compound is added to the solid fuel, such as coal, before firing in the kiln to reduce the resistivity of the dust-laden exhaust gases from the kiln.

Solid alkali-metal compounds may be added to the solid fuel and fired together with the solid fuel to obtain the required distribution in the gases and reactions with the fly ash particles.

Preferably, the conditioning agent—the alkali-metal compound or compounds—is added to the solid fuel before it is ground. An intimate making of the fuel and the conditioning agent is thus achieved so that the chemical composition of the fly ash may be influenced by the conditioning agent to obtain a resistivity below the above mentioned critical value, that is a resistivity of less than about $10^{10}$ ohm cm.

An alternative method is to add the alkali-metal compound by sprinkling the solid fuel with a solution of the compound. Thus a sprinkling of the fuel with sea water or other water containing water-soluble alkali-metal compounds results in an adequate addition of a conditioning agent.

It is preferred that the conditioning agent is added in amounts equivalent to a content of up to about 2 percent $Na_2O$ calculated on the basis of dust in the exhaust gases.

A preferred conditioning agent is solid NaCl added to the solid fuel in a ratio of less than about 1:200 corresponding to a sodium content in the exhaust gases equivalent to about 2 percent $Na_2O$.

The method has been tested and has given remarkable results. The results are unexpected because only a minimal amount of the dust in the exhaust gases originates in the fuel. Thus, in a lime burning plant which has a daily production of 260 tons and fired partly with solid fuel an improvement of the electrostatic precipitator efficiency from 99.1 percent to about 99.9 percent was obtained by adding, before grinding the solid fuel, 3.5% NaCl calculated on the basis of the amount of ash arising from the burning of the solid fuel. The gas temperature was 340° C.

The method is also applicable to firing of power plant boilers wherein the conditioning agent is added to coal.

The following example illustrates the method of the present invention. Although a preferred method is described below, it is merely illustrative and not considered to limit the present invention.

EXAMPLE I

Dry conditioning of dust from a 260 tons/24 hour lime kiln was carried out to improve performance of electrostatic precipitation at a lime plant.

The kiln was oil/coal fired in a proportion of 40/60 percent by weight oil/coal corresponding to 40 tons/24 hour coal. Before grinding in a coal mill, sodium chloride was dosed directly at the coal during transport on a belt-conveyor. The sodium chloride content corresponds to 0.43 percent by weight of coal.

$Na_2O$ content in the dust, precipitated in the precipitator, increased from 0.21 percent by weight to 0.30 percent by weight. The results showed a close relation between dosing of sodium chloride and precipitator performance. The resistivity of the dust decreased from $3.5\times10^{12}$ ohm cm to $1.5\times11^{11}$ ohm cm, which resulted in a decrease in stack dust concentration from 517 mg/nm$^3$ (milligram/normal cubic meter) dry gas to 64 mg/nm$^3$ dry gas. Migration velocity improved from 8.47 cm/sec to 12.73 cm/sec.

It is not intended to limit the present invention to the specific embodiments described above. Thus, it should be recognized that other changes may be made in the method specifically described herein without deviating from the scope and teachings of this invention and that it is intended to encompass all other embodiments, alternatives and modifications consistent with the present invention.

I claim:

1. A method of conditioning exhaust gases, containing substantial amounts of dust and lesser amounts of fly ash, from burning processes in a kiln plant, with an electrostatic precipitator, for the treatment of mineral materials which produce the substantial amounts of dust during treatment comprising:

(a) taking a solid fuel;

(b) adding to said fuel at least one alkali-metal compound;

(c) grinding said solid fuel and alkali-metal compound such that at least a portion of the fuel assumes a solid pulverized condition;

(d) feeding into a rotary kiln mineral materials which, upon burning, produce substantial amounts of dust;

(e) introducing said fuel into the rotary kiln in its ground condition;

(f) firing the treated, solid ground fuel in the kiln to burn the mineral materials thereby producing a mineral product and exhaust gases containing the substantial amounts of dust and lesser amounts of fly ash which now contain alkali-metal to reduce resistance;

(g) separating the exhaust gases and the alkali-metal and dust and fly ash by precipitation in the electrostatic precipitator; and (h) recovering the conditioned exhaust gases.

2. A method of conditioning exhaust gases, containing substantial amounts of dust and lesser amounts of fly ash, from burning processes in a kiln plant, with an electrostatic precipitator, for the treatment of mineral materials which produce the substantial amounts of dust during treatment comprising:

(a) taking a solid fuel;

(b) grinding said solid fuel such that at least a portion of the fuel assumes a solid pulverized condition;

(c) adding to said solid ground fuel at least one alkali-metal compound;

(d) feeding into a rotary kiln mineral materials which, upon burning, produce substantial amounts of dust;

(e) introducing said fuel into the rotary kiln in its ground condition;

(f) firing the treated, solid ground fuel in the kiln to burn the mineral materials thereby producing a mineral product and exhaust gases containing the substantial amounts of dust and lesser amounts of fly ash which now contain alkali-metal to reduce resistance;

(g) separating the exhaust gases and the alkali-metal and dust and fly ash by precipitation in the electrostatic precipitator; and (h) recovering the conditioned exhaust gases.

3. The method according to claims 1 or 2 wherein said alkali-metal compound is added by sprinkling the solid fuel with a solution of said compound.

4. The method according to claims 2 or 3 wherein said alkali-metal compound is added in amounts equivalent to a content of up to about 2 percent $Na_2O$ calculated on the basis of dust in the exhaust gas.

5. The method according to claim 1 or 2 wherein said alkali-metal compound is solid NaCl added to the fuel in a ratio of less than about 1:200.

6. The method according to claim 1 or 2 wherein said solid fuel is coal.

7. The method according to claim 1 or 2 wherein the resistivity of the exhaust gases is less than about $10^{10}$ ohm cm.

8. The method according to claim 1 or 2 wherein said alkali-metal compound is water soluble.

9. The method according to claim 8 wherein said alkali-metal compound is NaCl.

10. The method according to claim 1 or 2 wherein said alkali-metal compound is dissolved in sea water.

* * * * *

UNITED STATES PATENT AND TRADEMARK OFFICE

CERTIFICATE OF CORRECTION

PATENT NO. : 4,391,207

DATED : July 5, 1983

INVENTOR(S) : Helge Petersen

It is certified that error appears in the above-identified patent and that said Letters Patent is hereby corrected as shown below:

In Column 1, line 17, "Art" should be --ART--.

In Column 2, line 44, "making" should be --mixing--.

In Column 4, line 45, "claim" should be --claims--.

In Column 4, line 48, "claim" should be --claims--.

In Column 4, line 50, "claim" should be --claims--.

In Column 4, line 53, "claim" should be --claims--.

In Column 4, line 57, "claim" should be --claims--.

Signed and Sealed this

*Eighth* Day of *May 1984*

[SEAL]

*Attest:*

GERALD J. MOSSINGHOFF

*Attesting Officer*

*Commissioner of Patents and Trademarks*